US009852697B2

(12) United States Patent
Lim et al.

(10) Patent No.: US 9,852,697 B2
(45) Date of Patent: Dec. 26, 2017

(54) ORGANIC LIGHT EMITTING DIODE DISPLAY

(71) Applicant: LG Display Co., Ltd., Seoul (KR)

(72) Inventors: Myunggi Lim, Gyeonggi-do (KR); Kyoungdon Woo, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 52 days.

(21) Appl. No.: 14/854,301

(22) Filed: Sep. 15, 2015

(65) Prior Publication Data

US 2016/0078806 A1 Mar. 17, 2016

(30) Foreign Application Priority Data

Sep. 17, 2014 (KR) ..... 10-2014-0123781

(51) Int. Cl.
*G09G 3/32* (2016.01)
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0828* (2013.01); *G09G 2320/029* (2013.01); *G09G 2320/0233* (2013.01); *G09G 2320/0271* (2013.01); *G09G 2320/0295* (2013.01);
(Continued)

(58) Field of Classification Search
None
See application file for complete search history.

(56) References Cited

U.S. PATENT DOCUMENTS

2005/0280614 A1 12/2005 Goh
2009/0079678 A1 3/2009 Ozawa
2013/0063498 A1 3/2013 Yabukane
(Continued)

FOREIGN PATENT DOCUMENTS

CN 101393719 A 3/2009
CN 103383833 A 11/2013
(Continued)

OTHER PUBLICATIONS

Japanese Office Action dated Aug. 16, 2016 for corresponding Japanese Patent Application No. 2015-180759.
(Continued)

*Primary Examiner* — Tony N Ngo
(74) *Attorney, Agent, or Firm* — Morgan, Lewis & Bockius LLP

(57) ABSTRACT

An organic light emitting diode display includes a display panel including a plurality of pixels, each pixel including an organic light emitting diode (OLED) and a driving thin film transistor (TFT) configured to control an amount of current flowing in the OLED depending on a difference between a data voltage and a reference voltage, a source driver integrated circuit (IC) configured to produce the data voltages corresponding to data of an input image and apply the data voltages to data lines connected to the pixels, an image analyzer configured to analyze the data of the input image and produce reference voltage control data, and a reference voltage regulator configured to produce the reference voltages varying depending on the input image based on the reference voltage control data and apply the reference voltages to reference lines connected to the pixels.

6 Claims, 11 Drawing Sheets

(52) U.S. Cl.
CPC ..... *G09G 2320/043* (2013.01); *G09G 2320/0626* (2013.01); *G09G 2330/028* (2013.01)

(56) References Cited

U.S. PATENT DOCUMENTS

| | | | | |
|---|---|---|---|---|
| 2013/0293600 | A1* | 11/2013 | Lee ..... | G09G 3/3258 345/691 |
| 2015/0123953 | A1 | 5/2015 | Shim et al. | |
| 2015/0138179 | A1 | 5/2015 | Park | |
| 2015/0154908 | A1 | 6/2015 | Nam et al. | |
| 2015/0187268 | A1 | 7/2015 | Tani et al. | |
| 2015/0379937 | A1 | 12/2015 | Kim et al. | |

FOREIGN PATENT DOCUMENTS

| | | | |
|---|---|---|---|
| JP | 2009-075319 | A | 4/2009 |
| JP | 2013061390 | A | 4/2013 |
| KR | 10-2015-0052606 | A | 5/2015 |
| KR | 10-2015-0057672 | A | 5/2015 |
| KR | 10-2015-0064798 | A | 6/2015 |
| KR | 10-2015-0077815 | A | 7/2015 |
| KR | 10-1549343 | B | 8/2015 |
| KR | 10-2016-0001822 | A | 1/2016 |

OTHER PUBLICATIONS

The First Office Action dated Aug. 3, 2017, from the State Intellectual Property Office of People's Republic of China, in related Cinese application No. 201510587312.1.

* cited by examiner

ORGANIC LIGHT EMITTING DIODE DISPLAY

This application claims the benefit of Korean Patent Application No. 10-2014-0123781 filed on Sep. 17, 2014, which is incorporated herein by reference for all purposes as if fully set forth herein.

BACKGROUND OF THE INVENTION

Field of the Invention

The present invention relates to an organic light emitting diode display.

Discussion of the Related Art

An active matrix organic light emitting diode display includes organic light emitting diodes (OLEDs) capable of emitting light by itself and has advantages of a fast response time, a high emission efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

The organic light emitting diode display arranges pixels each including the OLED in a matrix form and adjusts a luminance of the pixels based on gray levels of video data. As shown in FIG. 1, each pixel may include a driving thin film transistor (TFT) DT controlling a driving current flowing in the OLED, a first switching TFT ST1 which is turned on in response to a first gate pulse SCAN and applies a data voltage Vdata to a gate node Ng of the driving TFT DT, a second switching TFT ST2 which is turned on in response to a second gate pulse SEN and applies a reference voltage VREF to a source node Ns of the driving TFT DT, and a storage capacitor Cst for holding a gate-to-source voltage Vgs of the driving TFT DT for a predetermined period of time. The driving TFT DT controls a magnitude of the driving current supplied to the OLED depending on a magnitude of the voltage Vgs stored in the storage capacitor Cst and adjusts an amount of light emitted by the OLED. The amount of light emitted by the OLED is proportional to a current supplied from the driving TFT DT.

The data voltage Vdata applied to the gate node Ng of the driving TFT DT varies depending on data of an input image, but the reference voltage VREF applied to the source node Ns of the driving TFT DT is applied to all of the pixels at a fixed value irrespective of the input image as shown in FIG. 2. The reference voltage VREF generally uses a voltage greater than 0V, so as to prepare for case where a threshold voltage of the driving TFT DT is negatively shifted. Thus, as shown in FIG. 3, because the gate-to-source voltage Vgs of the driving TFT DT defining a gray-level representation region is less than the maximum data voltage Vdata, it is impossible to implement a luminance corresponding to the maximum data voltage Vdata. This reduces the gray-level representation and leads to a reduction in image quality. For example, FIG. 4 shows a relationship between the gate-to-source voltage Vgs and the driving current Ids when the reference voltage VREF is fixed to 3 V.

SUMMARY OF THE INVENTION

Accordingly, the present invention is directed to an organic light emitting diode display that substantially obviates one or more of the problems due to limitations and disadvantages of the related art.

An object of the present invention is to provide an organic light emitting diode display capable of increasing gray-level representation and improving image quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purposed of the present invention, as embodied and broadly described, an organic light emitting diode display comprises a display panel including a plurality of pixels, each pixel including an organic light emitting diode (OLED) and a driving thin film transistor (TFT) configured to control an amount of current flowing in the OLED depending on a difference between a data voltage supplied through a data line and a reference voltage supplied through a reference line; a source driver integrated circuit (IC) configured to produce the data voltages corresponding to data of an input image and apply the data voltages to the data lines connected to the pixels; an image analyzer configured to analyze the data of the input image and produce reference voltage control data; and a reference voltage regulator configured to produce the reference voltages varying depending on the input image based on the reference voltage control data and apply the reference voltages to the reference lines connected to the pixels.

The reference voltage regulator individually regulates the reference voltages on a per pixel basis.

The reference voltage regulator includes a plurality of regulation units connected to the reference lines. Each regulation unit includes a digital-to-analog converter configured to produce the reference voltage corresponding to the reference voltage control data using the reference voltage control data, and an amplifier configured to supply the reference voltage input from the digital-to-analog converter to the corresponding reference line.

The amplifier is used to sense change in electrical characteristic of the driving TFT in a previously set sensing mode. The amplifier operates as a unit gain buffer when supplying the reference voltage to the corresponding reference line.

The reference voltage regulator individually regulates the reference voltages on a per display block basis, where each display block includes at least two pixels.

The image analyzer differently produces the reference voltage control data depending on display gray levels of the input image. The reference voltage regulator produces the reference voltage, which is regulated to increase as the input image becomes darker, based on the reference voltage control data. The reference voltage regulator produces the reference voltage, which is regulated to decrease as the input image becomes brighter, based on the reference voltage control data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 5 to 14.

Figure 1:
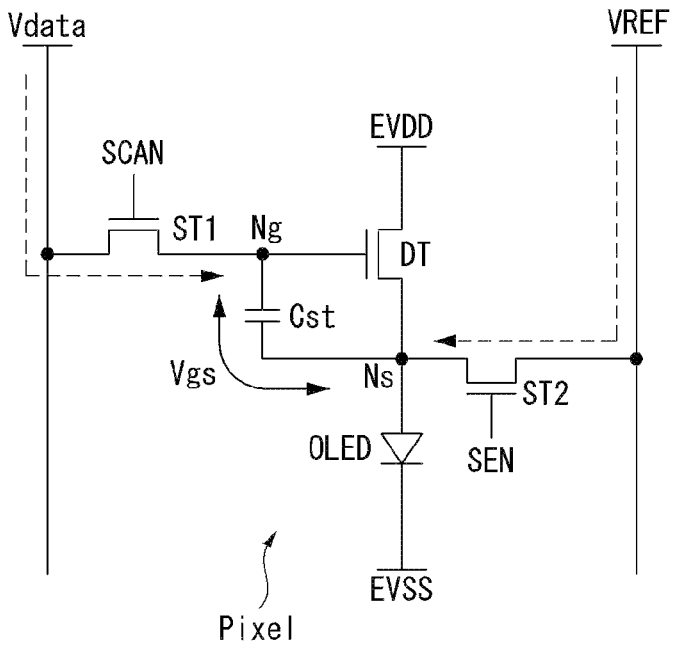
FIG. 1 (RELATED ART)
FIG. 1 is a circuit diagram showing configuration of one pixel of a related art organic light emitting diode display.
Figure 2:
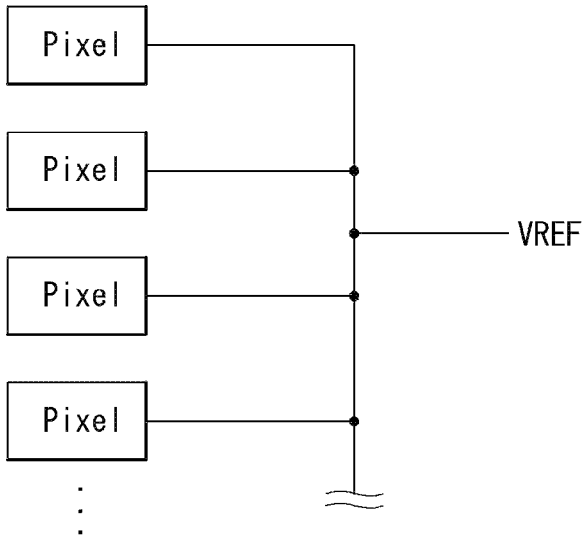
FIG. 2 (RELATED ART)
FIG. 2 shows that a reference voltage is applied to all of pixels at a fixed value irrespective of an input image in a in a related art organic light emitting diode display.
Figure 3:
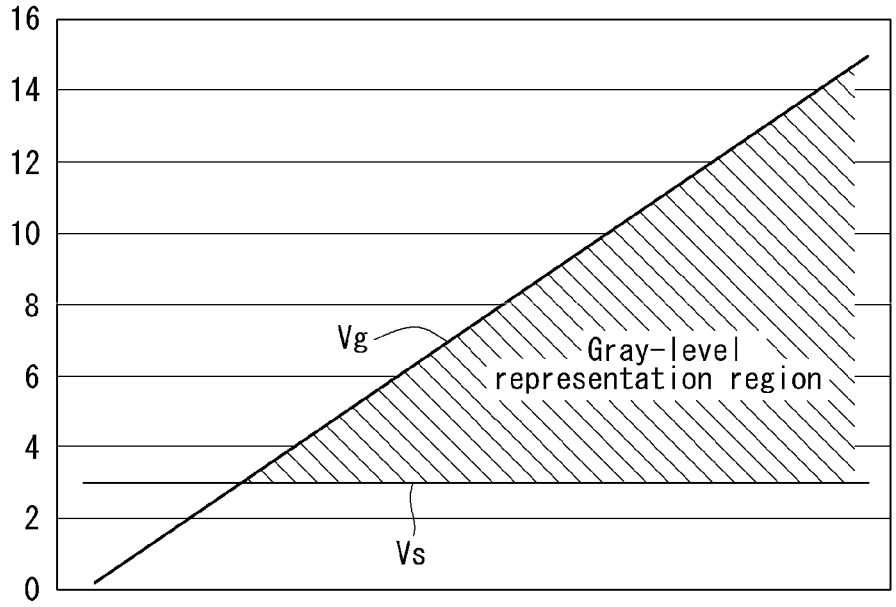
FIG. 3 (RELATED ART)
FIG. 3 shows that a gate-to-source voltage of a driving thin film transistor (TFT) is less than a maximum data voltage to reduce gray-level representation in a related art organic light emitting diode display.
Figure 4:
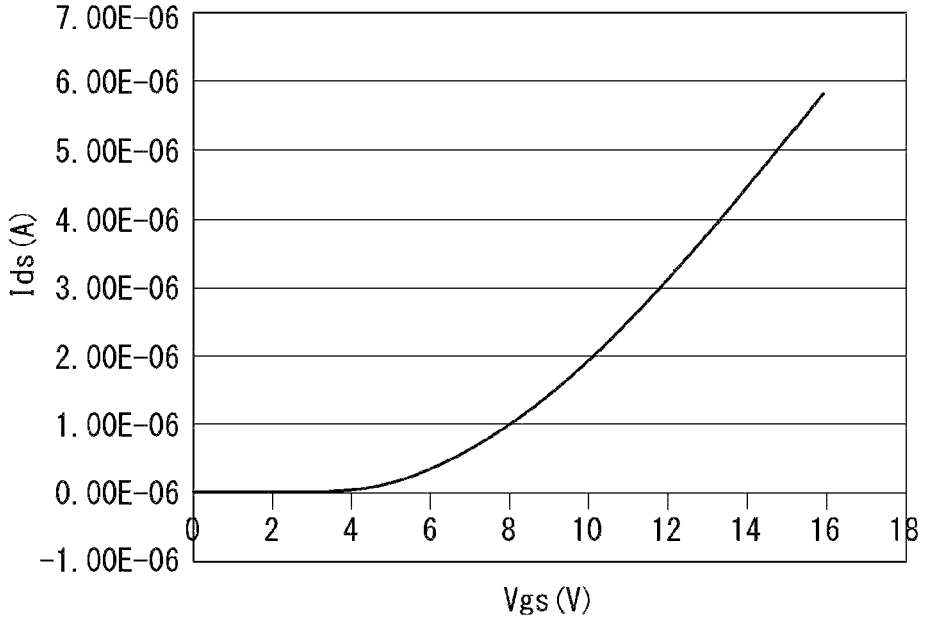
FIG. 4 (RELATED ART)
FIG. 4 is a graph showing a relationship between a gate-to-source voltage and a driving current when a reference voltage is fixed to 3 V in a related art organic light emitting diode display.
Figure 5:
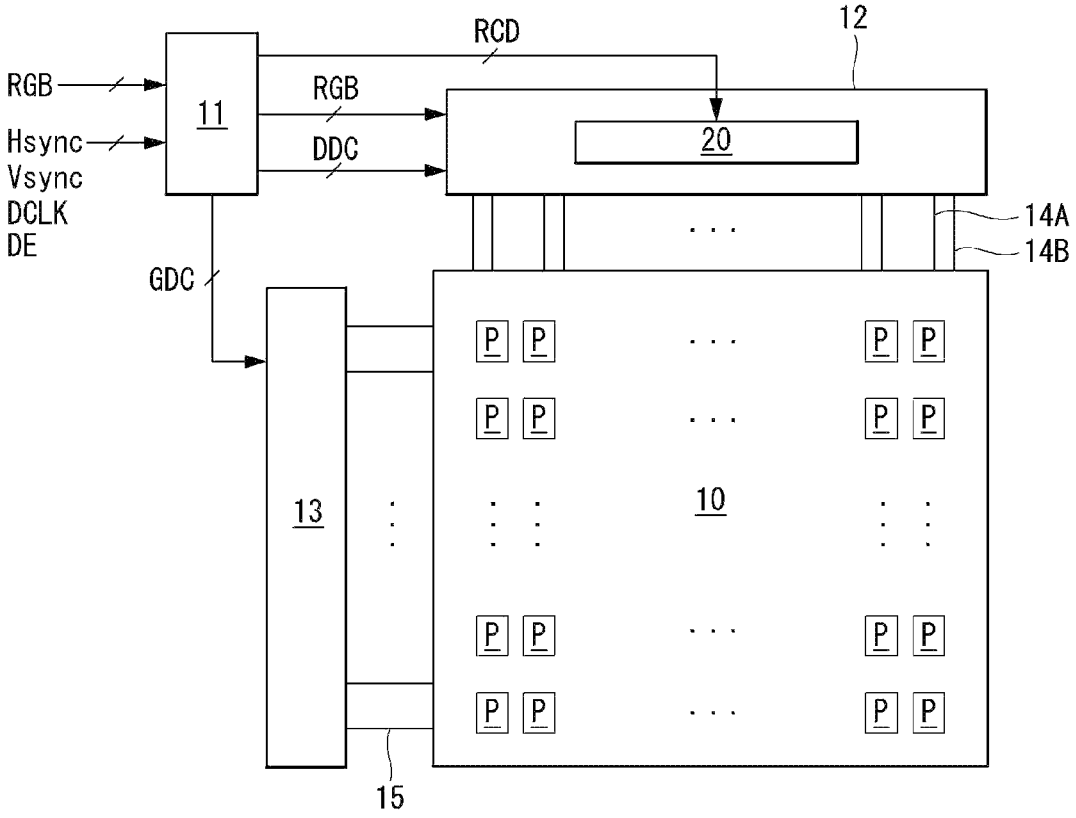
FIG. 5 is a block diagram of an organic light emitting diode display according to an exemplary embodiment of the invention.

FIG. 5 is a block diagram of an organic light emitting diode display according to an exemplary embodiment of the invention.

Referring to FIG. 5, the organic light emitting diode display according to the embodiment of the invention includes a display panel 10, a timing controller 11, a data driving circuit 12, a gate driving circuit 13, and a reference voltage regulator 20.

A plurality of data and reference lines 14A and 14B and a plurality of gate lines 15 cross each other on the display panel 10, and pixels P are respectively disposed at crossings of the lines 14A, 14B, and 15 in a matrix form.

Each pixel P is connected to one of the data lines 14A, one of the reference lines 14B, and one of the gate lines 15. Each pixel P receives a data voltage from the data line 14A in response to a gate pulse input through the gate line 15 and receives a reference voltage from the reference line 14B.

The timing controller 11 generates a data control signal DDC for controlling operation timing of the data driving circuit 12 and a gate control signal GDC for controlling operation timing of the gate driving circuit 13 based on timing signals, such as a vertical sync signal Vsync, a horizontal sync signal Hsync, a dot clock DCLK, and a data enable signal DE. The timing controller 11 rearranges data RGB of an input image received from an external host system and supplies the rearranged data RGB to the data driving circuit 12.

In particular, the timing controller 11 may include an image analyzer 111 (refer to FIGS. 6 and 7) which analyzes the data RGB of the input image and produces reference voltage control data RCD.

The data driving circuit 12 converts the input image data RGB received from the timing controller 11 into the data voltage in response to the data control signal DDC and supplies the data voltage to the data lines 14. The data driving circuit 12 may include the reference voltage regulator 20.

The reference voltage regulator 20 produces reference voltages varying depending on the input image based on the reference voltage control data RCD from the timing controller 11 and applies the reference voltages to the reference lines 14B connected to the pixels P. The reference voltage regulator 20 may individually regulate the reference voltages on a per pixel basis through a connection configuration shown in FIGS. 6 and 7. Alternatively, the reference voltage regulator 20 may individually regulate the reference voltages on a per block basis through a connection configuration shown in FIG. 14, where one block includes at least two pixels.

The gate driving circuit 13 produces a gate pulse in response to the gate control signal GDC and then may sequentially supply the gate pulse to the gate lines 15. The gate pulse is used to control switching thin film transistors (TFTs) of the pixel and may include a first gate pulse and a second gate pulse.

Figure 6:
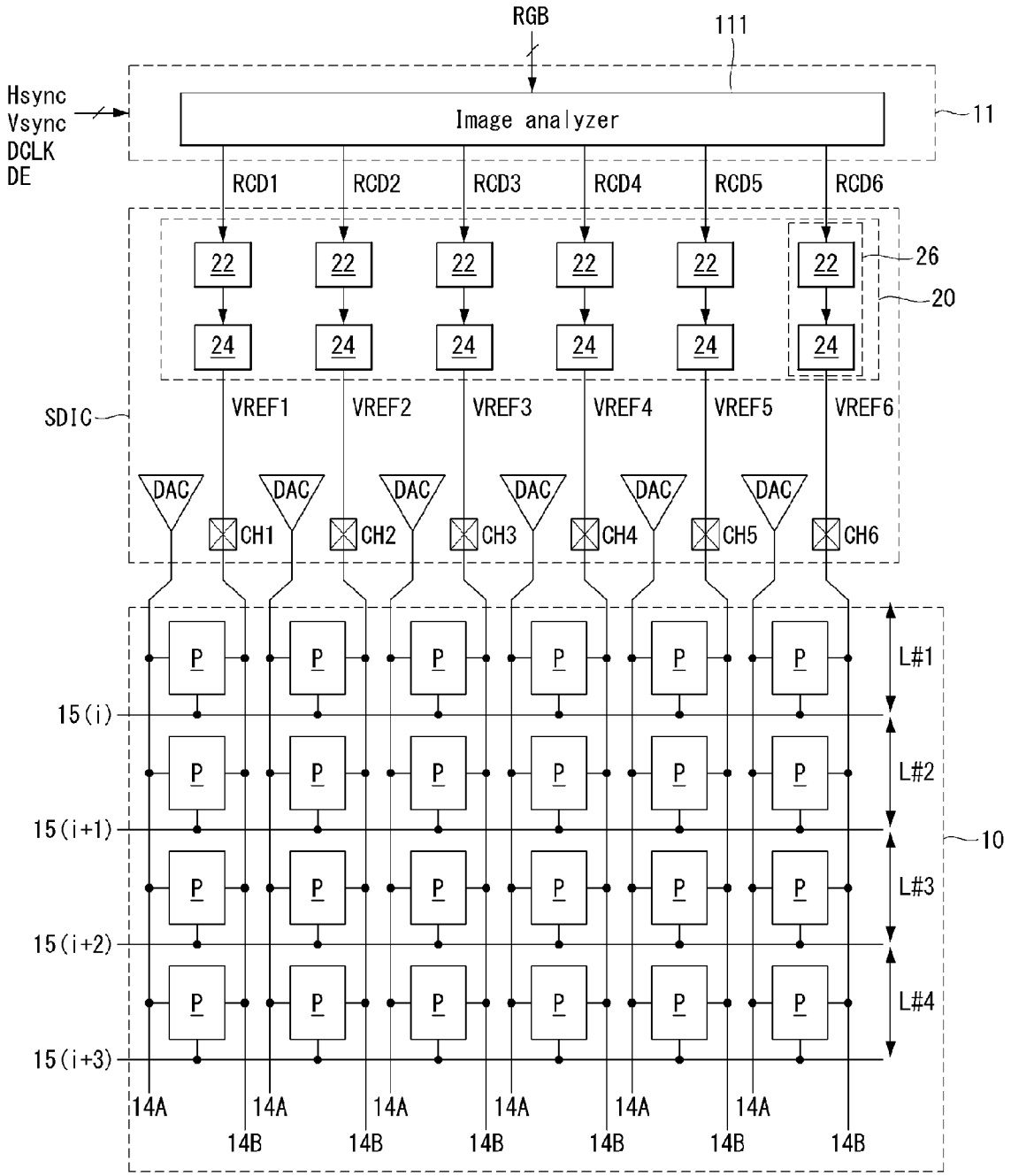
FIG. 6 shows an example of connection configuration between a source driver integrated circuit (IC), in which an image analyzer and a reference voltage regulator are embedded, and a display panel.
Figure 7:
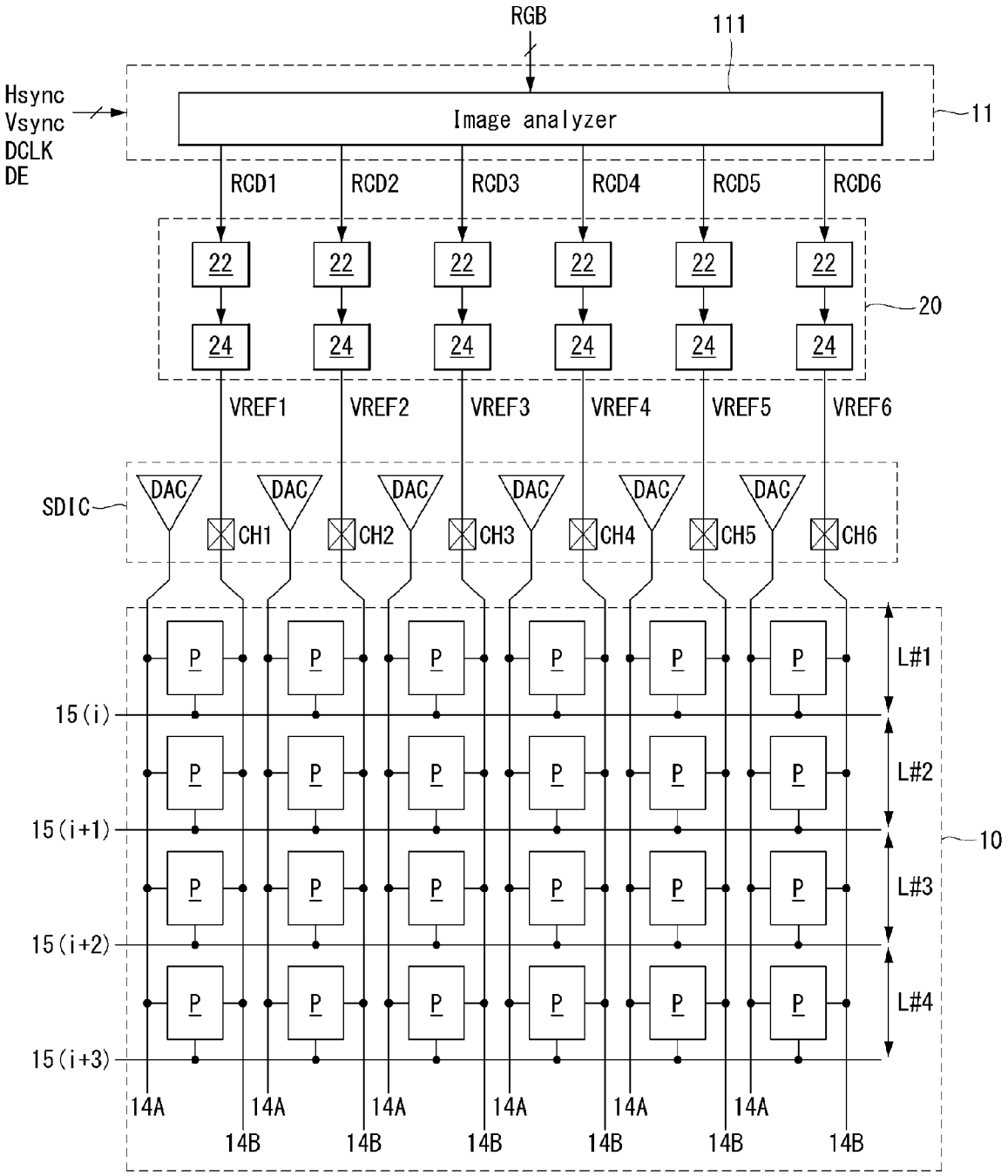
FIG. 7 shows an example of connection configuration between an image analyzer, a reference voltage regulator, a source driver IC, and a display panel.

FIG. 6 shows an example of connection configuration between a source driver integrated circuit (IC), in which an image analyzer and a reference voltage regulator are embedded, and the display panel. FIG. 7 shows an example of connection configuration between an image analyzer, a reference voltage regulator, a source driver IC, and the display panel.

The data driving circuit 12 includes at least one source driver IC SDIC, and the timing controller 11 includes the image analyzer 111. The image analyzer 111 analyzes the data RGB of the input image through various known methods and differently produces reference voltage control data RCD1 to RCD6 depending on display gray levels of the input image.

Referring to FIG. 6, the source driver IC SDIC includes a plurality of first digital-to-analog converters (DACs) respectively connected to the data lines 14A and the reference voltage regulator 20 connected to the reference lines 14B through supply channels CH1 to CH6.

The first DACs convert the input image data RGB into the data voltage in response to the data control signal DDC and supply the data voltage to the data lines 14A connected to the pixels P.

The reference voltage regulator 20 is embedded in the source driver IC SDIC and produces reference voltages VREF1 to VREF6 varying depending on the input image based on the reference voltage control data RCD1 to RCD6 from the image analyzer 111. The reference voltage regulator 20 applies the reference voltages VREF1 to VREF6 to the reference lines 14B connected to the pixels P. In particular, the reference voltage regulator 20 may produce the reference voltage, which is regulated to increase as the input image becomes darker, and may produce the reference voltage, which is regulated to decrease as the input image becomes brighter, based on the reference voltage control data RCD1 to RCD6 so as to improve gray-level representation. This is described in detail with reference to FIGS. 9 to 11.

The reference voltage regulator 20 may include a plurality of regulation units 26, and each regulation unit 26 may include a second DAC 22 and an amplifier 24. The regulation units 26 may be respectively connected to the reference lines 14B through the supply channels CH1 to CH6, so that the reference voltage can be individually regulated on a per pixel basis. The reference voltages VREF1 to VREF6 supplied to the reference lines 14B may be applied to the pixels P on each of lines L#1, L#2, . . . in a line sequential manner in synchronization with the gate pulse.

The embodiment of the invention may adopt an external compensation method, as a method for compensating for change in electric characteristic of a driving TFT, disclosed in detail in Korean Patent Application Nos. 10-2013-0134256 (Nov. 6, 2013), 10-2013-0141334 (Nov. 20, 2013), 10-2013-0166678 (Dec. 30, 2013), 10-2013-0149395 (Dec. 3, 2013), 10-2014-0079255 (Jun. 26, 2014), and 10-2014-0079587 (Jun. 27, 2014) corresponding to the present applicant, and which are hereby incorporated by reference in their entirety. The external compensation method uses a voltage sensing method or a current sensing method to sense change in the electric characteristic of the driving TFT. For this, the source driver IC includes an amplifier therein.

As shown in FIG. 6, when the reference voltage regulator 20 is embedded in the source driver IC, the amplifier provided for the above external compensation method may operate as a unit gain buffer. Therefore, the amplifier operating as the unit gain buffer may use the amplifier 24 for supplying the reference voltage. In other words, the amplifier 24 according to the embodiment of the invention may serve as the unit gain buffer or a sensing amplifier depending on the purpose it is used for. When the amplifier 24 may serve as the sensing amplifier, the amplifier 24 is used to sense change in the electrical characteristic of the driving TFT in a previously set sensing mode as in the above applications corresponding to the present applicant.

Referring to FIG. 7, the reference voltage regulator 20 is not embedded in the source driver IC SDIC and may be mounted on a source printed circuit board (PCB) constituting the data driving circuit 12, separately from the source driver IC SDIC. In this instance, because the second DACs 22 do not need to be embedded in the source driver IC SDIC, configuration of the source driver IC SDIC may be simplified.

Figure 8:
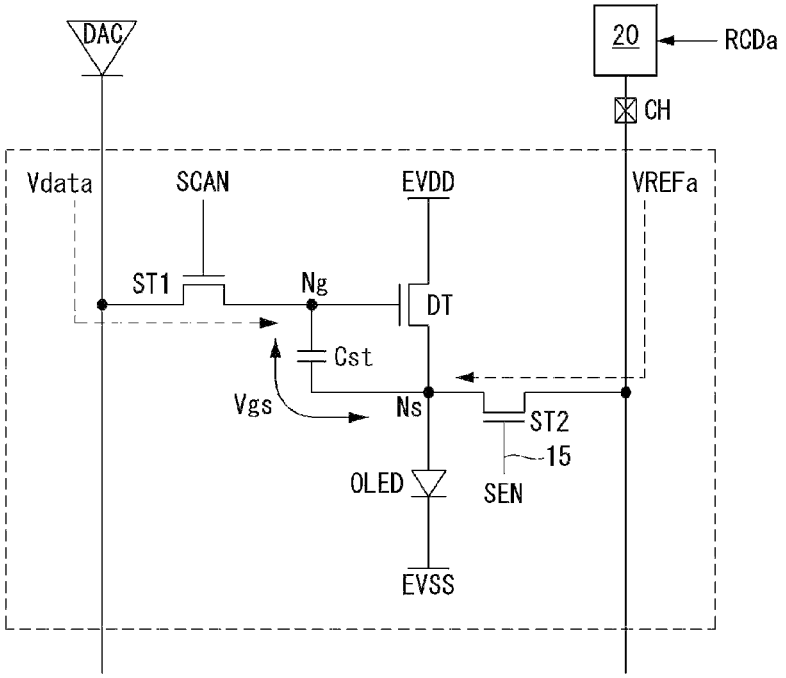
FIG. 8 is a circuit diagram showing an example of configuration of a pixel formed in a display panel.

FIG. 8 is a circuit diagram showing an example of configuration of a pixel formed in the display panel. The pixel configuration of FIG. 8 is merely an example configured so that an amount of current flowing in an organic light emitting diode (OLED) is controlled depending on a difference Vgs between the data voltage and the reference voltage. Therefore, the pixel configuration according to the embodiment of the invention may be variously changed.

Referring to FIG. 8, a pixel P receives a high potential driving voltage EVDD and a low potential driving voltage EVSS from a power generator (not shown). The pixel P may include an OLED, a driving TFT DT, a storage capacitor Cst, a first switching TFT ST1, and a second switching TFT ST2. The TFTs constituting the pixel P may be implemented as a p-type TFT or an n-type TFT. A semiconductor layer of the TFT may include amorphous silicon, polysilicon, or oxide.

The OLED includes an anode electrode connected to a gate node Ng of the driving TFT DT, a cathode electrode connected to an input terminal of the low potential driving voltage EVSS, and an organic compound layer formed between the anode electrode and the cathode electrode.

The driving TFT DT controls an amount of current flowing in the OLED depending on a gate-to-source voltage Vgs of the driving TFT DT. The driving TFT DT includes a gate electrode connected to the gate node Ng, a drain electrode connected to an input terminal of the high potential driving voltage EVDD, and a source electrode connected to a source node Ns of the driving TFT DT. The storage capacitor Cst is connected between the gate node Ng and the source node Ns of the driving TFT DT and holds the gate-to-source voltage Vgs of the driving TFT DT for a predetermined period of time.

The first switching TFT ST1 is turned on in response to a first gate pulse SCAN and applies a data voltage Vdata to the gate node Ng of the driving TFT DT. The first switching TFT ST1 includes a gate electrode connected to the gate line 15, a drain electrode connected to the data line 14A, and a source electrode connected to the gate node Ng. The second switching TFT ST2 is turned on in response to a second gate pulse SEN and applies a reference voltage VREFa to the source node Ns of the driving TFT DT. In the embodiment disclosed herein, the reference voltage VREFa is produced by the reference voltage regulator 20 based on reference voltage control data RCDa and is supplied to the reference line 14B. The second switching TFT ST2 includes a gate electrode connected to the gate line 15, a drain electrode connected to the reference line 14B, and a source electrode connected to the source node Ns.

The driving TFT DT controls a magnitude of a driving current supplied to the OLED depending on a difference Vgs between the data voltage Vdata and the reference voltage VREFa stored in the storage capacitor Cst and adjusts an amount of light emitted by the OLED. The amount of light emitted by the OLED is proportional to the current supplied from the driving TFT DT.

Figure 9:
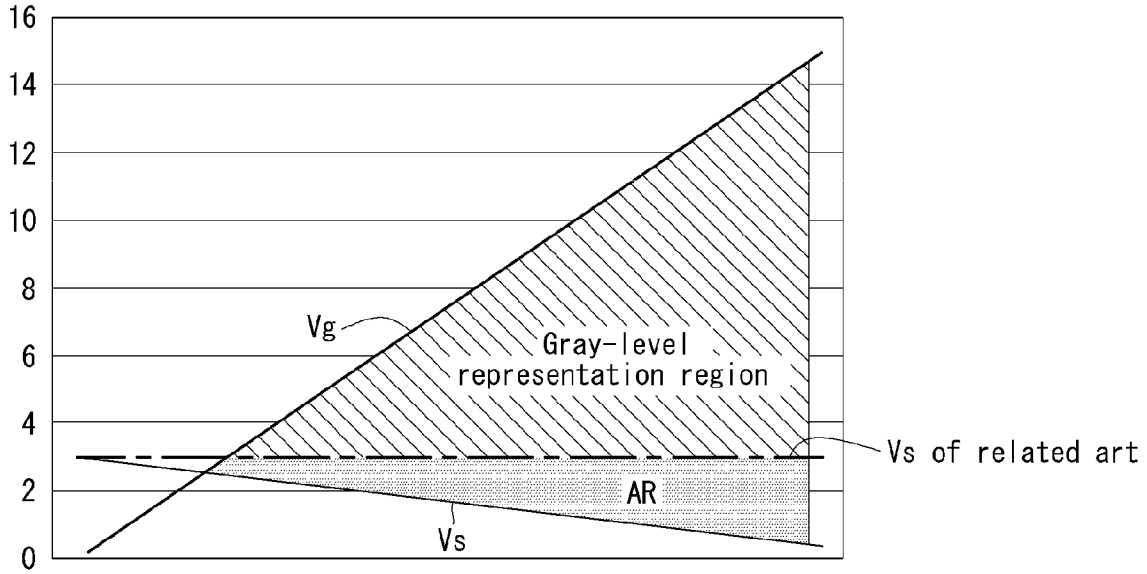
FIG. 9 shows that gray-level representation is improved by a reference voltage according to an embodiment of the invention, which is regulated depending on an input image.
Figure 10:
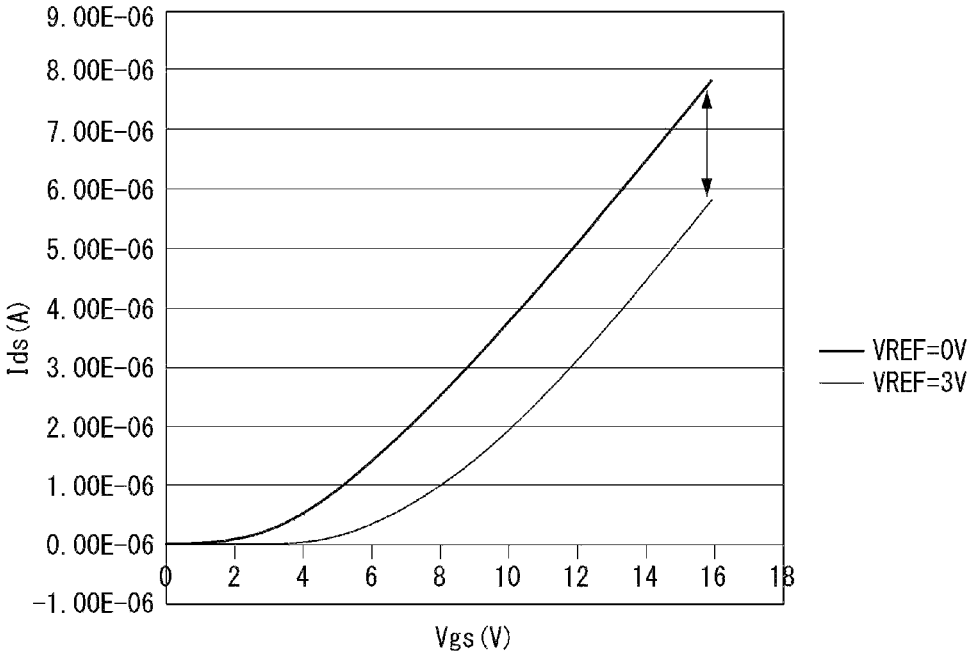
FIG. 10 is a graph showing change in a current flowing in an organic light emitting diode when a reference voltage is 0V and 3V.

FIG. 9 shows that gray-level representation is improved by the reference voltage according to the embodiment of the invention, which is regulated depending on the input image. FIG. 10 is a graph showing change in the current flowing in the OLED when the reference voltage is 0V and 3V.

In the embodiment of the invention, the reference voltage VREF applied to the source node Ns of the driving TFT DT may vary in every horizontal period in the same manner as the data voltage Vdata applied to the gate node Ng of the driving TFT DT. The embodiment of the invention can vary both the data voltage Vdata and the reference voltage VREF and thus can represent the gray levels more minutely than a related art, in which the gray levels are represented by varying only the data voltage Vdata in a state where the reference voltage VREF is fixed. For example, when the input image data RGB is implemented as 10 bits and the reference voltage control data RCD is implemented as 5 bits, the gray-level representation of 15 bits can be performed.

As shown in FIG. 9, a gray-level representation region in the embodiment of the invention is greater than a gray-level representation region in the related art by an area "AR" due to such a bit extension effect. In FIG. 9, "Vg" is a gate voltage of the driving TFT DT and denotes the data voltage Vdata applied to the gate node Ng of the driving TFT DT, and "Vs" is a source voltage of the driving TFT DT and indicates the reference voltage VREF applied to the source node Ns of the driving TFT DT.

The embodiment of the invention may produce the reference voltage VREF as 3V with respect to a darkest image of a black gray level, may produce the reference voltage VREF as 0V with respect to a brightest image of a white gray level, and may produce the reference voltage VREF as a value between 0V and 3V with respect to an image of a middle gray level between the black gray level and the white gray level. Referring to FIG. 10, the embodiment of the invention may produce the reference voltages VREF as 3V, so as to prepare for case where a threshold voltage of the driving TFT DT is negatively shifted, namely, for the image of the black gray level. Further, the embodiment of the invention may produce the reference voltage VREF as 0V with respect to the image of the white gray level and may increase the gate-to-source voltage Vgs of the driving TFT DT, thereby increasing the current Ids flowing in the OLED. Hence, the embodiment of the invention can implement a full white luminance and can increase the gray-level representation.

Figure 11:
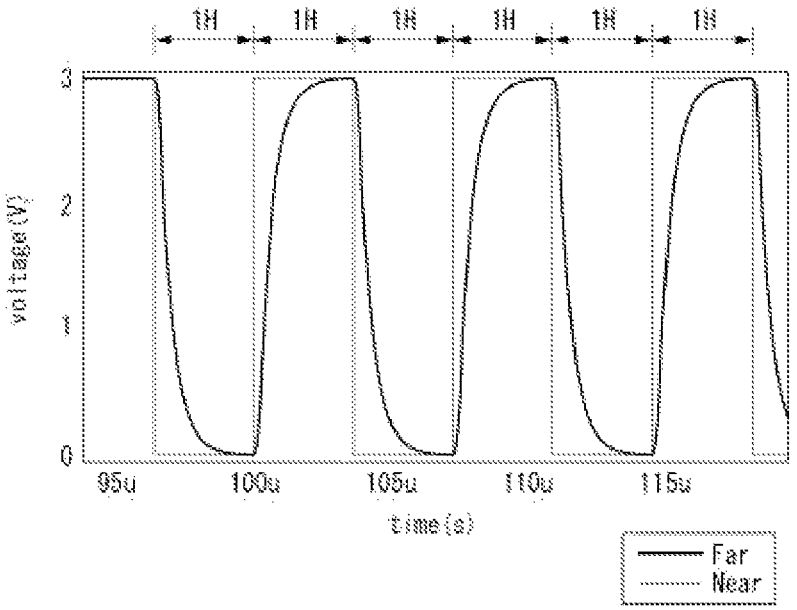
FIG. 11 shows a simulation result of a swing waveform of a reference voltage when the reference voltage is alternately set to 0V and 3V in a cycle of one horizontal period.

FIG. 11 shows a simulation result of a swing waveform of the reference voltage when the reference voltage is alternately set to 0V and 3V in a cycle of one horizontal period.

In FIG. 11, the reference voltage for implementing a full white gray level was set to 0V, and the reference voltage for implementing a full black gray level was set to 3V. In FIG. 11, a waveform indicated by bold solid line shows changes in the reference voltage in a portion far away from the supply channel (i.e., an input location) when the reference voltage swings, and a waveform indicated by thin solid line shows changes in the reference voltage in a portion near to the supply channel (i.e., the input location) when the reference voltage swings. Referring to the waveforms, the reference voltage may change from 0V to 3V in one horizontal period 1H even in the portion far away from the supply channel in consideration of a panel load.

Figure 12:
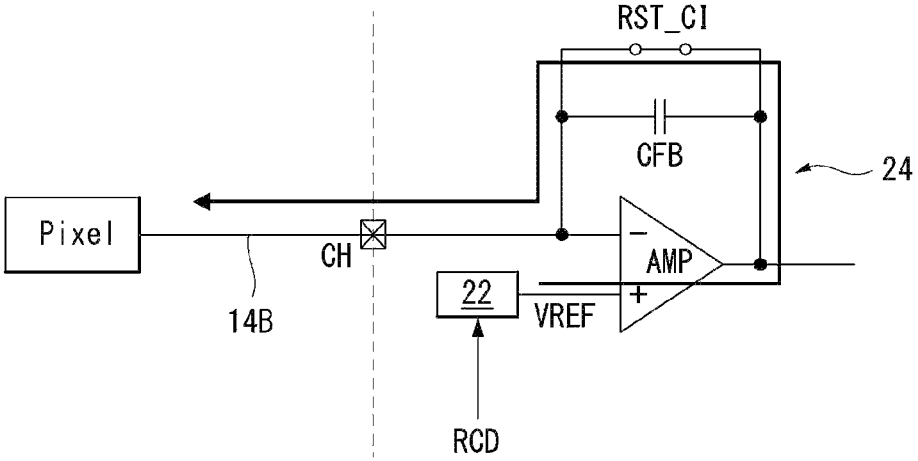
FIG. 12 shows an example of a regulation unit included in a reference voltage regulator.
Figure 13:
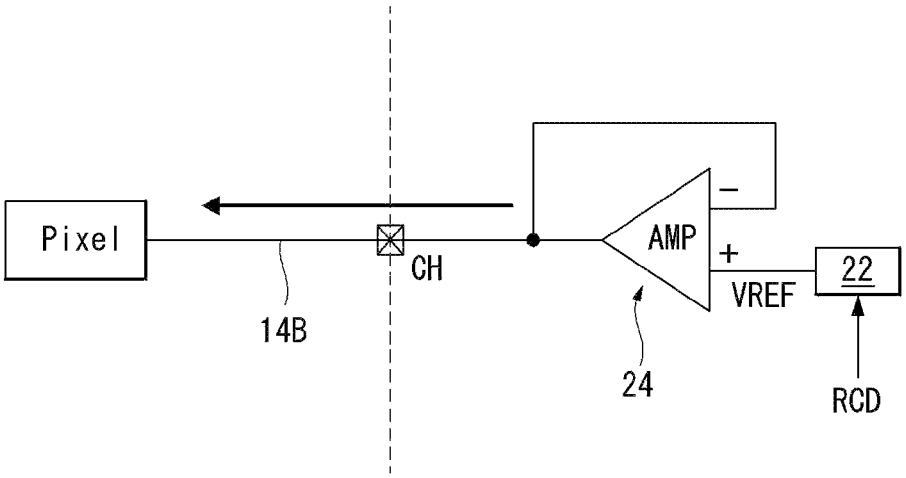
FIG. 13 shows another example of a regulation unit included in a reference voltage regulator.

FIG. 12 shows an example of one regulation unit included in the reference voltage regulator. FIG. 13 shows another example of one regulation unit included in the reference voltage regulator.

A regulation unit 26 according to the embodiment of the invention includes a second DAC 22 and an amplifier 24. The amplifier 24 may have structures shown in FIGS. 12 and 13.

The amplifier 24 of FIG. 12 is an integrating amplifier used in the current sensing method. In the sensing of the current, the amplifier 24 serves as an integrator which turns off an internal switch RST_CI and accumulates a sensing current on an integrating capacitor CFB. In the supply of the reference voltage, the amplifier 24 serves as a unit gain buffer turning on an internal switch RST_CI.

The amplifier 24 of FIG. 13 is an amplifier used in the voltage sensing method. In the sensing of the voltage, the amplifier 24 passes through the sensing voltage using a separate switch (not shown). In the supply of the reference voltage, the amplifier 24 serves as a unit gain buffer, FIG. 14 shows an example where the reference voltages are individually regulated on a display block basis.

Figure 14:
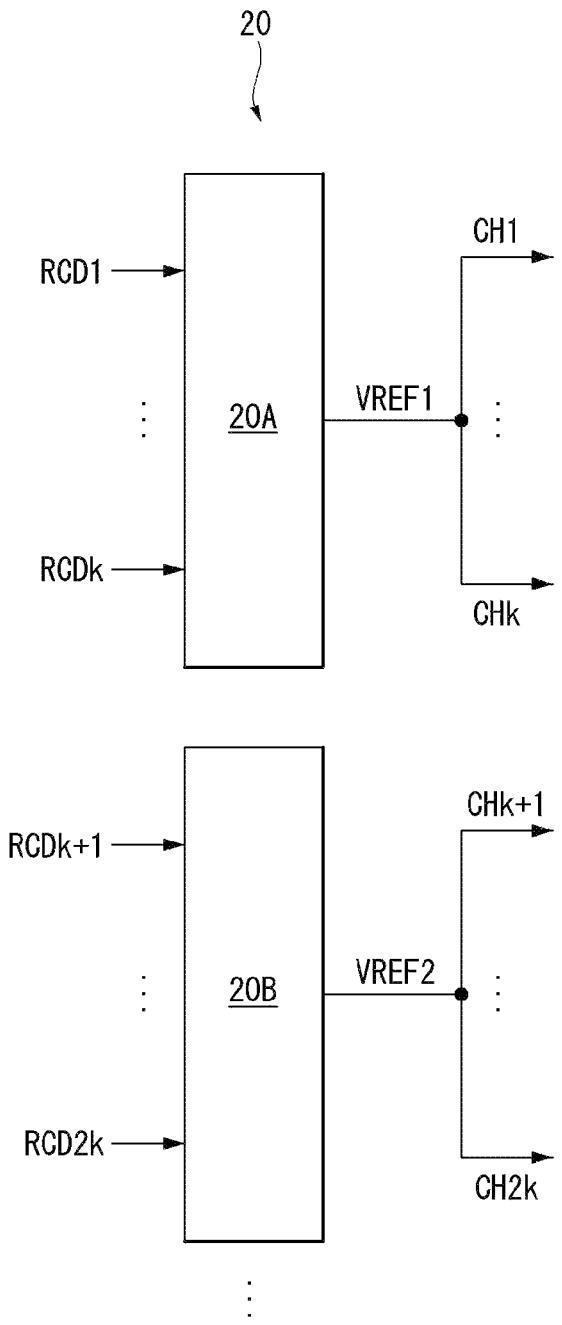
FIG. 14 shows an example where reference voltages are individually regulated on a display block basis.

As shown in FIG. 14, the reference voltage regulator 20 may includes a plurality of block regulators 20A and 20B, so that the reference voltages VREF are individually regulated on a per display block basis, where each display block includes at least two pixels. Each of the block regulators 20A and 20B may produce one reference voltage based on k reference voltage control data RCD and may commonly apply the one reference voltage to k supply channels CH, where k is a positive integer equal to or greater than 2. In other words, the same reference voltage is applied to k pixels belonging to one display block.

As described above, the embodiment of the invention regulates the reference voltage as well as the data voltage depending on the input image, thereby increasing the gray-level representation and increasing the image quality.

It will be apparent to those skilled in the art that various modifications and variations can be made in the organic light emitting diode display of the present invention without departing from the spirit or scope of the invention. Thus, it is intended that the present invention cover the modifications and variations of this invention provided they come within the scope of the appended claims and their equivalents.

What is claimed is:

1. An organic light emitting diode display, comprising:

a display panel including a plurality of pixels, each pixel including an organic light emitting diode (OLED) and a driving thin film transistor (TFT) configured to control an amount of current flowing in the OLED depending on a difference between a data voltage supplied through a data line and a reference voltage supplied through a reference line;

a source driver integrated circuit (IC) configured to produce the data voltages corresponding to data of an input image and apply the data voltages to the data lines connected to the pixels;

an image analyzer configured to analyze the data of the input image and produce reference voltage control data; and a reference voltage regulator configured to produce the reference voltages varying depending on the input image based on the reference voltage control data and apply the reference voltages to the reference lines connected to the pixels, wherein the driving TFT includes a gate electrode to which the data voltage is supplied, a drain electrode connected to an input terminal of a high potential driving voltage, and a source electrode connected to the reference line through a switching TFT, and wherein the reference voltage is applied to the source electrode of the driving TFT.

2. The organic light emitting diode display of claim 1, wherein the reference voltage regulator individually regulates the reference voltages on a per pixel basis.

3. The organic light emitting diode display of claim 2, wherein the reference voltage regulator includes a plurality of regulation units connected to the reference lines, wherein each regulation unit includes:

a digital-to-analog converter configured to produce the reference voltage corresponding to the reference voltage control data using the reference voltage control data; and an amplifier configured to supply the reference voltage input from the digital-to-analog converter to the corresponding reference line.

4. The organic light emitting diode display of claim 3, wherein the amplifier is used to sense change in electrical characteristic of the driving TFT in a previously set sensing mode, and wherein the amplifier operates as a unit gain buffer when supplying the reference voltage to the corresponding reference line.

5. The organic light emitting diode display of claim 1, wherein the reference voltage regulator individually regulates the reference voltages on a per display block basis, where each display block includes at least two pixels.

6. The organic light emitting diode display of claim 1, wherein the image analyzer differently produces the reference voltage control data depending on display gray levels of the input image, wherein the reference voltage regulator produces the reference voltage, which is regulated to increase as the input image becomes darker, based on the reference voltage control data, and wherein the reference voltage regulator produces the reference voltage, which is regulated to decrease as the input image becomes brighter, based on the reference voltage control data.

* * * * *